US005455085A

United States Patent [19]

Miller

[11] Patent Number: 5,455,085

[45] Date of Patent: Oct. 3, 1995

[54] DOUBLE PANE MICROWAVE WINDOW

[75] Inventor: Curtis G. Miller, Long Beach, Calif.

[73] Assignee: Hughes Aircraft Company, Los Angeles, Calif.

[21] Appl. No.: 163,802

[22] Filed: Feb. 17, 1994

[51] Int. Cl.[6] ..... E06B 3/24; H01P 1/08

[52] U.S. Cl. ..... 428/34; 428/137; 428/192; 333/252; 52/786.1; 52/786.13

[58] Field of Search ..... 428/34, 192, 131, 428/137, 138; 52/788, 784, 790; 156/107, 109; 333/248, 252, 99 PL

[56] References Cited

U.S. PATENT DOCUMENTS 5,132,652 7/1992 Doehler et al. ..... 333/252
5,234,526 8/1993 Chen et al. ..... 156/345

*Primary Examiner*—Donald J. Loney
*Attorney, Agent, or Firm*—Terje Gudmestad; W. K. Denson-Low

[57] ABSTRACT

A window has two plates of radiation-propagative material, such as two plates of glass or two films of transparent dimensionally-stable plastic which serve as window panes through which electromagnetic radiation can propagate. The panes are spaced apart by one quarter wavelength of the radiation by a spacer block to provide for cancellation of any reflected wave. The window is readily disassembled to permit replacement of the spacer block to increase or to decrease the spacing as may be required to adjust the window for a different frequency band of radiation. Also, the construction of the window permits its mounting within the aperture of a wall, and to serve for joining two waveguides, thereby, to facilitate use of the window in the conduct of tests in a laboratory. The spacer block with the transparent plates thereon are positioned between a base and a cap, both of which are configured for attachment to waveguides. The base and the spacer block and the cap are provided with openings arranged coaxially and through which radiant energy propagates. A set of bolts and alignment pins extend through the window components for facile assembly and disassembly.

7 Claims, 4 Drawing Sheets

DOUBLE PANE MICROWAVE WINDOW

BACKGROUND OF THE INVENTION

This invention relates to a window for coupling electromagnetic energy through a wall, and between two waveguides, particularly between two environments such as a high pressure environment and a low pressure environment, the window having two panes spaced apart by a quarter wavelength for inhibiting reflection, and having a construction permitting easy disassembly for replacement of components for adapting the window to different frequencies of radiation.

Windows are used for coupling radiation, both electromagnetic and acoustic radiations, between different environments and between different conduits of radiation, such as between two waveguides. Of particular interest herein is the construction of a window for electromagnetic radiation. The window is to be suitable for use in satellite communications wherein alignment and test of the satellite electronics is to occur in a laboratory on the earth while the satellite electronics may be mounted within a vacuum chamber to simulate the environment of outer space. It is, therefore, necessary to provide a window capable of withstanding differences in environmental conditions, such as differences in pressure, and to have a construction suitable for joining waveguides passing through a wall separating the two environmental regions. Furthermore, for accurate testing of the satellite electronics, the window should prevent the generation of reflected waves of radiation, and should have a form of construction which facilitates interchanging of window components for tuning the window to operate in different frequency bands of microwave radiation.

A problem arises in that presently available windows to not provide all of the foregoing desirable features, so that a compromise is necessary in selecting a window for use in a laboratory test situation. This unnecessarily complicates the test procedure and may decrease the attainable accuracy in measurements of the satellite signal processing capabilities.

SUMMARY OF THE INVENTION

The aforementioned problems are overcome and other advantages are provided by a window which, in accordance with the invention, has two plates of radiation-propagative material, such as two plates of glass or two films of transparent dimensionally-stable plastic which serve as window panes through which electromagnetic radiation can propagate. The panes are spaced apart by one quarter wavelength of the radiation, or an odd integral number of one quarter wavelengths of the radiation, to provide for cancellation of any reflected wave. A spacer block is located between the two panes to provide for the requisite spacing, and the window is readily disassembled to permit replacement of the spacer block to increase or to decrease the spacing as may be required to adjust the window for a different frequency band of radiation. Also, the construction of the window permits its mounting within the aperture of a wall, and to serve for joining two waveguides, thereby, to facilitate use of the window in the conduct of tests in a laboratory.

In accordance with a preferred embodiment of the invention, wherein the window may be secured to wall of a vacuum chamber enclosing satellite electronics or other devices under test, the window comprises a base secured to the wall, the base extending across an aperture in the wall and having a first opening overlying at least a part of the aperture. In addition, there is provided the aforementioned spacer block having opposed front and back surfaces and a second opening extending from the front surface to the back surface. The panes of transparent material are disposed as a front plate and a back plate located respectively on the front and the back surfaces of the spacer block, each of the plates extending across the second opening. Finally, there is provided a cap having a third opening, wherein the spacer block is located between the base and the cap, the first and the second and the third openings being coaxial, and the front plate abutting the base and the back plate abutting the cap.

In order to facilitate assembly and disassembly of the window, in accordance with a feature of the invention, the window includes a set of bolts extending from the cap toward the base for securing the base and the cap to the spacer block, a retraction of the bolts permitting replacement of the said spacer block, as well as either one or both of the panes. Also, it is noted that the aperture in the wall provides clearance to a waveguide behind the wall to permit attachment of the waveguide to the base, the window base being configured for attachment of the waveguide. Similarly, the cap is configured for attachment of another waveguide to the cap. To facilitate alignment of the window components during assembly, there is provided a set of pins extending from the cap through the spacer block for alignment of the plates with the block and the cap., the pins extending further into the base for alignment of the spacer block with the base.

BRIEF DESCRIPTION OF THE DRAWINGS

The aforementioned aspects and other features of the invention are explained in the following description, taken in connection with the accompanying drawing wherein.

DETAILED DESCRIPTION

Figure 1:
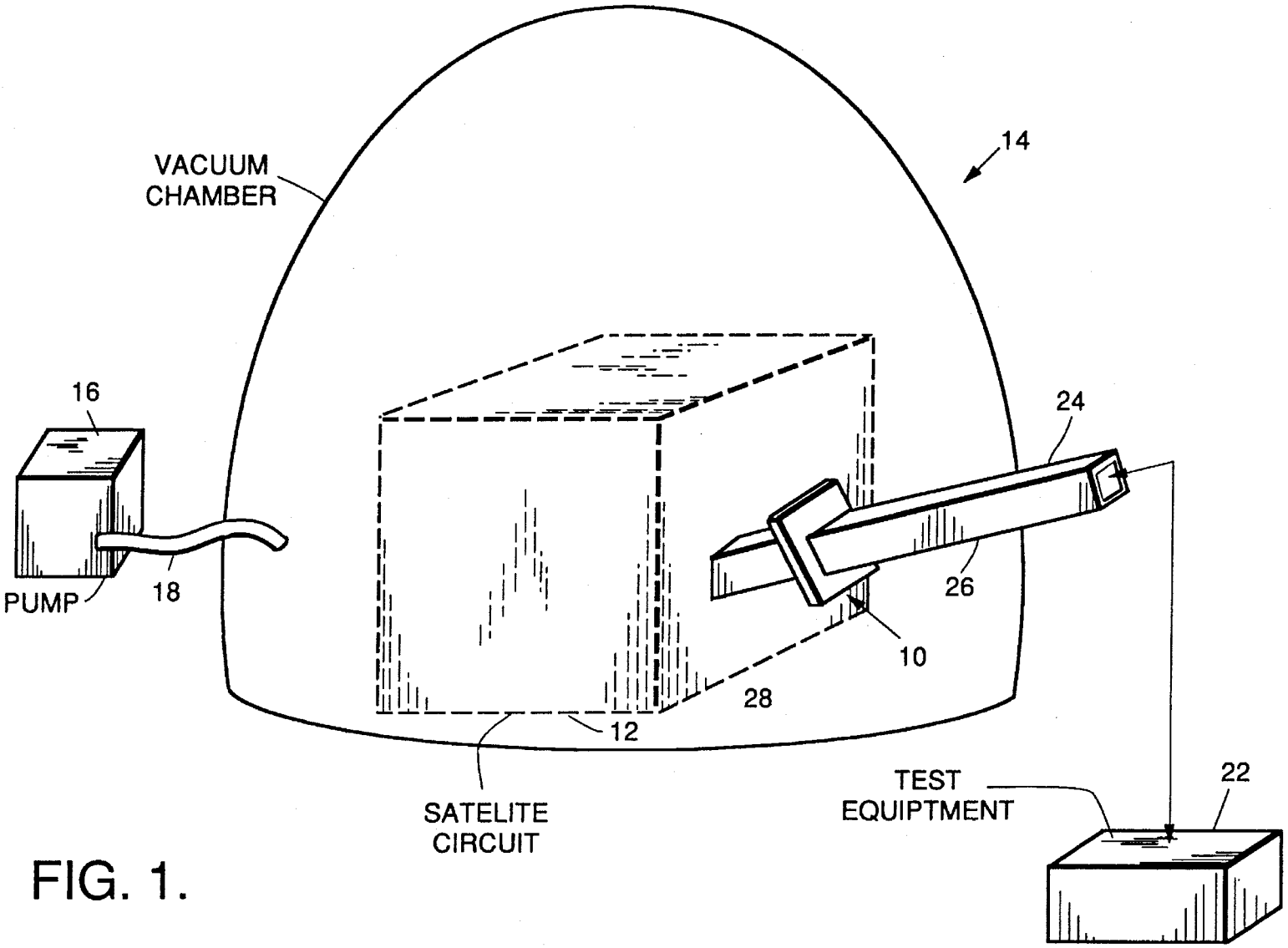
FIG. 1 shows a stylized view of electrical circuitry being operated in a vacuum chamber with access to the circuitry being had via a window constructed in accordance with the invention.

FIG. 1 shows an example of use of a window 10, constructed in accordance with the invention, in a laboratory for testing microwave electronic circuitry 12. The circuitry 12 is to be employed in a satellite encircling the earth and, accordingly, the circuitry 12 is enclosed in a chamber 14 which is evacuated by a vacuum pump 16 to simulate the environment of outer space. The pump 16 connects via a hose 18 to a wall 20 of the chamber 14 for withdrawal of air from the interior of the chamber 14. Testing of the circuitry 12 is accomplished by use of test equipment 22 which is located outside the chamber 14. The test equipment 22 includes a source (not shown) of microwave electromagnetic signals which are coupled from the test equipment 22 via a waveguide assembly 24 to the satellite circuitry 12 within the chamber 14. The waveguide assembly 24 passes through the chamber wall 20, and comprises a first waveguide 26 disposed outside the chamber 14, a second waveguide 28 disposed inside the chamber 14, and the window 10 which is disposed at the chamber wall 20 and serves to join the first waveguide 26 to the second waveguide 28. The window 10, in accordance with the invention, provides the dual functions of providing a path of propagation for electromagnetic energy through the chamber wall 20, and of preventing the ingress of outside atmosphere through the wall 20. As will be shown in the ensuing description, the window 10 has sufficient strength to withstand the differential pressure between the environments outside and inside the chamber 14.

Figure 2:
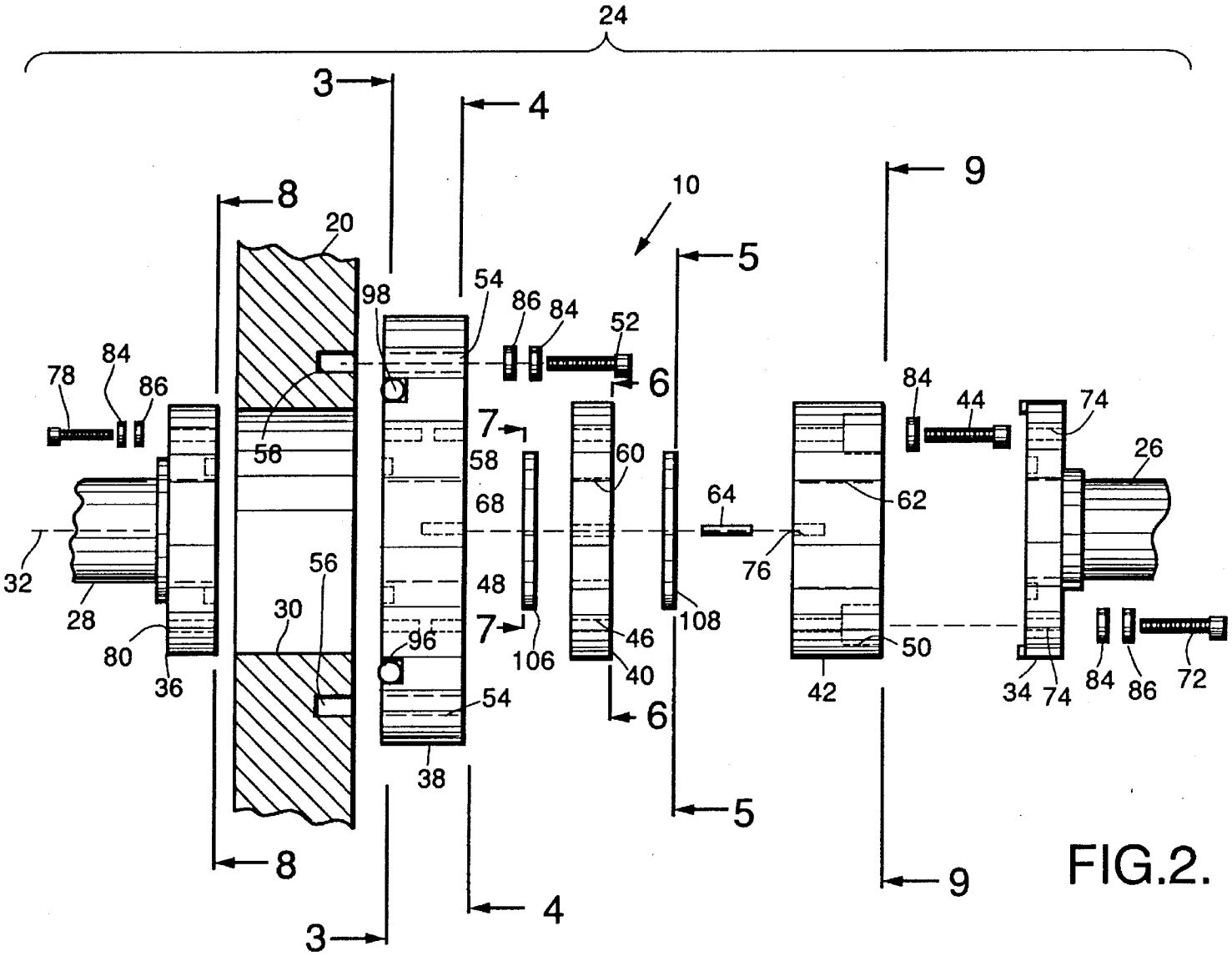
FIG. 2 shows an exploded plan view of the window of FIG. 1 taken along the line 2—2 in FIG. 3, a fragmentary portion of a wall of the chamber being shown in cross-section.
Figure 4:
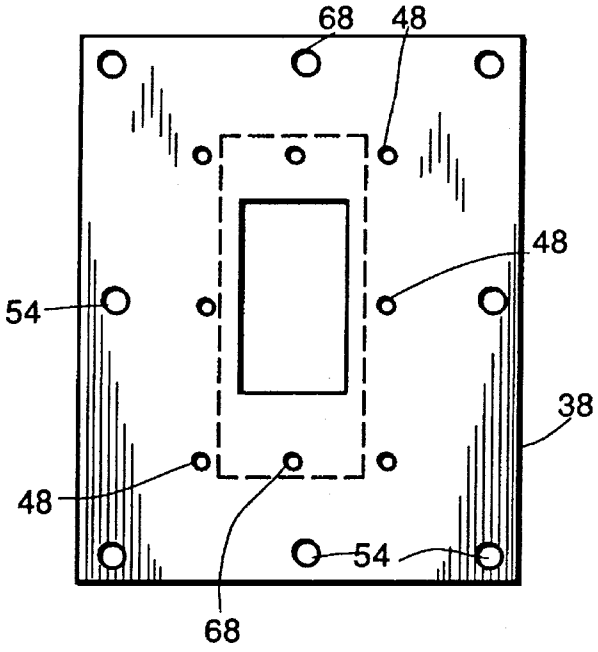
FIG. 4 shows a rear elevation view of the base of the window, taken along the line 4—4 in FIG. 2.

As shown in FIG. 2, the window 10 is located at the site of an aperture 30 in the chamber wall 20. The aperture 30 lies transverse to the direction of propagation of electromagnetic power along an axis 32 of the waveguide assembly 24, and provides a passage through the wall 20 for the electromagnetic power. The waveguides 26 and 28 are provided with flanges 34 and 36, respectively, for securing the waveguides 26 and 28 to the window 10. The flanges 34 and 36 have the same configuration, a plan view of a face of the flange 36 being shown in FIG. 8. The aperture 30 is sufficiently large in cross sectional dimensions to provide clearance of the flange 36, thereby to enable the second waveguide 28 to be passed through the wall 20 to meet the window 10.

With reference to FIGS. 2–9, the window 10 comprises a base 38, a spacer block 40, and a cap 42. The spacer block 40 is disposed between the base 38 and the cap 42, and is secured to the base 38 and the cap 42 by screws 44 (one of which is shown in FIG. 2), the screws 44 passing through clearance holes 46 (FIGS. 2, 5) in the spacer block 40 to be secured within tapped holes 48 (FIGS. 2, 4) of the base 38. A plan view of a face of the spacer block 40 appears in FIG. 5, the configuration of this face of the spacer block 40 being the same as the configuration of the mating face of the cap 42. The opposite face of the cap 42 is shown in plan view in FIG. 9. The clearance holes 46 and the tapped holes 48 are distributed symmetrically about the axis 32. The cap 42 is provided with a corresponding set of counterbored clearance holes 50 for receiving the head and stem portions of respective ones of the screws 44. The window 10 is mounted to the chamber wall 20 by means of screws 52 (one of which is shown in FIG. 2), the screws 52 extending through clearance holes 54 (FIGS. 2, 3, 4) in the base 38 to be secured in tapped holes 56 in the chamber wall 20. The base 38 has a central opening 58 (FIGS. 2, 3, 4) which extends through the base 38, the spacer block 40 has a central opening 60 (FIGS. 2, 5) which extends through the spacer block 40, and the cap 42 has a central opening 62 (FIGS. 2, 9) which extends through the cap 42. The openings 58, 60 and 62 are rectangular, are equal in size and shape to the interior cross-sectional dimensions of the waveguides 26 and 28, and are disposed coaxially with the wall aperture 30 along the axis 32. Alignment of the openings 58, 60 and 62 is attained with the aid of two alignment pins 64, one of which is shown in FIG. 2, the pins 64 passing through clearance holes 66 (FIGS. 2, 5) in the spacer block 40, with opposed ends of the pins 64 being secured in holes 68 (FIGS. 2, 4) and 70 (FIGS. 2, 9), respectively, in the base 38 and the cap 42. To facilitate assembly, it is advantageous to construct one of the holes 68 or 70, for each of the respective pins 64, as a blind hole having a predetermined depth and providing an interference fit with the pin 64 to hold the pin 64, in either the base 38 or the cap 42, as the base 38 and the cap 42 are assembled to the spacer block 40. The remaining one of the holes 70 or 68, respectively, would then be constructed with adequate depth and clearance for receiving the pin 64 during the assembly process.

Figure 8:
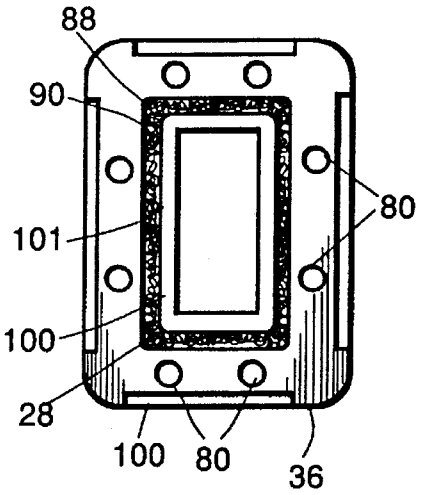
FIG. 8 is an elevation plan view of a face of a flange of a waveguide which connects with the window from within the chamber of FIG. 1, the view being taken along the line 8—8 in FIG. 2.
Figure 9:
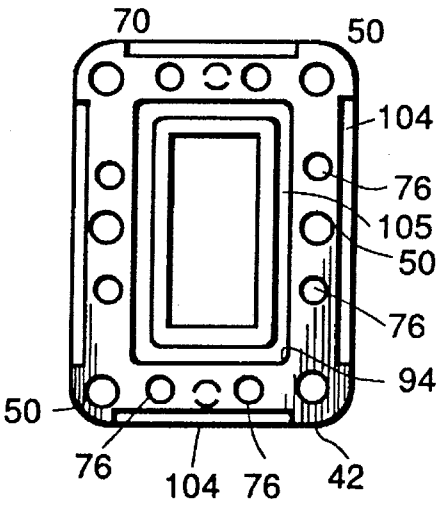
FIG. 9 shows a rear elevation view of a cap of the window, taken along the line 9—9 in FIG. 2.
Figure 5:
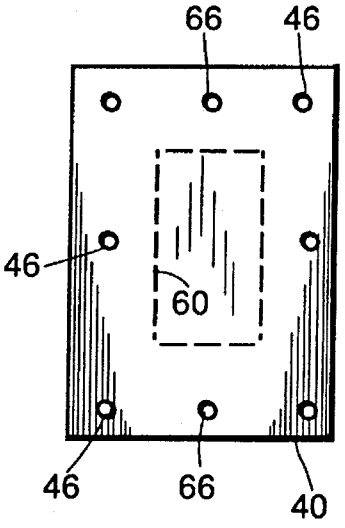
FIG. 5 shows a rear elevation view of a spacer block of the window, taken along the line 5—5 in FIG. 2.

After completion of the assembly of the window 10, the flange 34 of the first waveguide is attached by screws 72 (FIG. 2) to the cap 42, the screws 72 passing through clearance holes 74 of the flange 34 into tapped holes 76 (FIG. 9) of the cap 42. Attachment of the second waveguide 28 to the window 10 is accomplished by passing the flange 36 through the wall aperture 30, and then passing screws 78 through holes 80 (FIGS. 2, 8) of the flange 36 into tapped holes 82 (FIGS. 2, 3) of the base 38. Lock washers 84 and flat washers 86 may be employed for securing the screws 44, 52, 72 and 78, as shown in FIG. 2. R.F. (radio frequency) leakage is attenuated at the waveguide flange 36 by means of a silver-impregnated gasket 88 (FIG. 8) disposed in an encircling groove 90, and butting against a groove 92 (FIG. 3) in the base 38 upon attachment of the flange 36 to the base 38. In similar fashion, an R.F. gasket (not shown) is employed at the interface between the flange 34 of the first waveguide 26 and the cap 42, FIG. 9 showing a groove 94 for receiving the gasket. Alternatively, if desired, the flanges 34 and 36 may be enlarged to include a quarter wavelength choke (not shown) to attenuate R.F. leakage.

Figure 3:
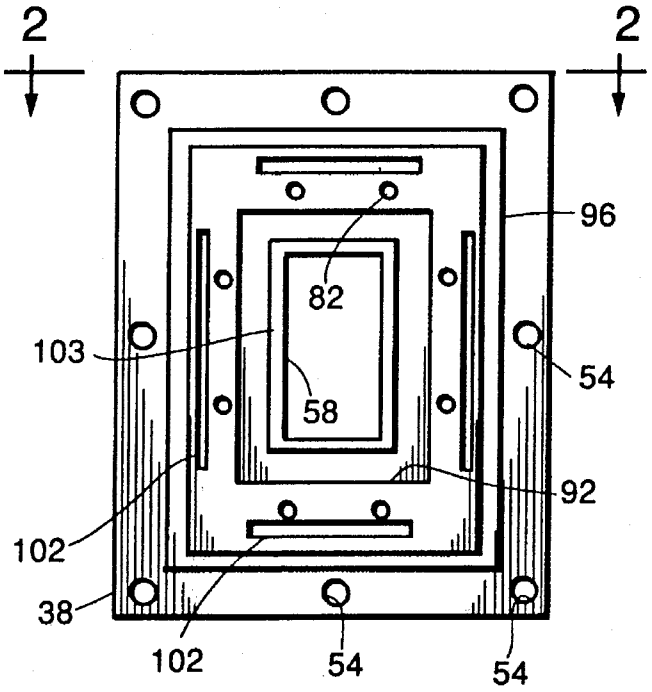
FIG. 3 shows a front elevation view of a base of the window, taken along the line 3—3 in FIG. 2.

An O-ring 96 (FIGS. 2, 3) is disposed in a groove 98 located on a front face of the base 38 for butting against the outer surface of the chamber wall 20 upon attachment of the base 38 to the wall 20, the gasket 96 protecting against seepage of air into the chamber 14 from the environment outside the chamber 14. Also shown in FIGS. 8 and 3, respectively, are raised contact regions 100 and 102 of the flange 36 and the base 38 which provide secure electrical connection between the waveguide 28 and the window 10 upon attachment of the flange 36 to the base 38. In addition, as shown in FIGS. 8 and 3, respectively, are raised contact regions 101 and 103 of the end of the waveguide 28 and the base 38 which also provide secure electrical connection between the waveguide 28 and the window 10 upon attachment of the flange 36 to the base 38. FIG. 9 shows similar raised contact regions 104 and 105 on the cap 42 for use in connecting the cap 42 to the flange 34 of the waveguide 26. The waveguides 26 and 28 and the wall 20 are made of a metal such as brass, by way of example, the brass being suitable also for manufacture of the base 38, the spacer block 40 and the cap 42 of the window 10.

Figure 6:
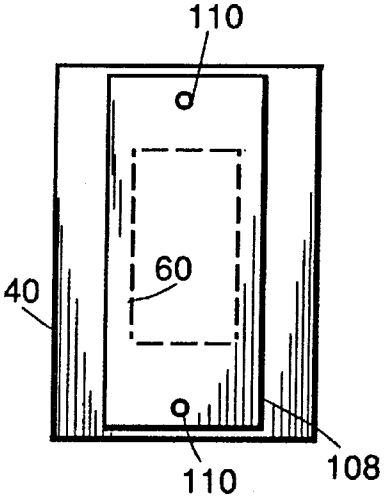
FIG. 6 shows a rear elevation view of a pane of the window superposed in registration with the spacer block of FIG. 5, the view being taken along the line 6—6 in FIG. 2.
Figure 7:
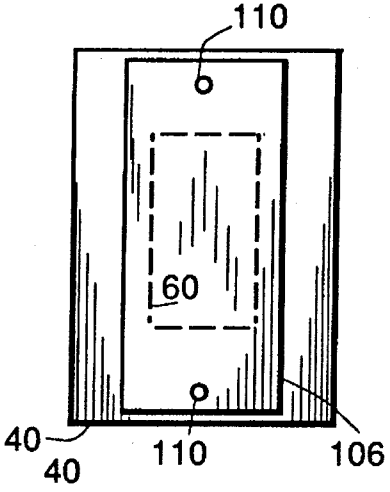
FIG. 7 shows a front elevation view of a further pane of the window superposed in registration with the spacer block of FIG. 5, the view being taken along the line 7—7 in FIG. 2.

In accordance with the invention, and as shown in FIGS. 2, 6 and 7, the window 10 further comprises a front plate 106 and a back plate 108 of material transparent to the electromagnetic radiation, the plates 106 and 108 being disposed on opposite sides of the spacer block 40 to serve as window panes which provide the dual functions of pressure seal against the outside environment and cancellation of reflected electromagnetic waves. Since the interior of the chamber 14 is in vacuum, each of the plates 106 and 108 is made strong enough to resist the pressure differential across the window 10, therefore to provide a redundant pressure seal. The plate 106 is located between the spacer block 40 and the base 38. The plate 108 is located between the spacer block 40 and the cap 42. In the preferred embodiment of the invention, the spacer block 40 provides for a spacing between the plates 106 and 108 of one quarter wavelength of the electromagnetic radiation propagating through the window 10. The quarter-wavelength spacing provides for cancellation between waves reflected back from each of the plates 108 and 106 resulting, for example, from power transmitted through the window 10 from the test equipment 22 to the satellite circuitry 12.

The cancellation process may be visualized by considering the generation of two reflected waves propagating back toward the test equipment 22, one reflected wave from the plate 108 and one reflected wave from the plate 106. Due to the quarter wavelength spacing or a spacing equal to an odd integral number of quarter wavelengths, the reflected wave from the plate 106 propagates an additional one half wavelength to be out of phase with the reflected wave from the plate 108 to provide the cancellation. Thereby, the two plates 106 and 108 are able to cancel out any reflected wave which might develop at the window 10 so as to insure propagation of the radiation without the development of reflections at the window 10.

The plates 106 and 108 are constructed in the preferred embodiment of the invention as sections of transparent plastic film, preferably, Mylar film having a thickness less than a tenth of a wavelength, preferably less than one twentieth of a wavelength to insure a substantially cophasal relationship between any reflections of waves from front and back surfaces of the film. In the preferred embodiment of the invention, the film of the plates 106 and 108 has a thickness in the range of 0.0005–0.001 inch. This thickness is adequate to provide strength for resisting the pressure differential, and sufficiently thin to insure low loss to radiation. For higher power transmission, the plastic film may be replaced with plate glass or quartz. In the case of the plate glass, a recess (not shown) may be provided in the base 38 and in the cap 42 for receiving the plates 106 and 108. Included with the recess would be an O-ring to provide a pressure seal in the manner described above for the O-ring 96.

The plates 106 and 108 are held in position by clamping between the base 38 and the block 40 and the cap 42, the clamping being provided by action of the screws 44. The alignment pins 64 pass through apertures 110 (FIGS. 6, 7) in each of the plates 106 and 108 to insure accurate positioning of the plates 106 and 108 in alignment with the central opening 60 of the spacer block 40. By way of example, in the case of the Mylar film construction of the plates 106 and 108, at a radiation frequency of 12–12.5 GHz (gigahertz), with a wavelength of approximately one inch, the waveguides 26 and 28 are fabricated of waveguide size WR75. In this case the cross-sectional dimensions of the openings 58, 60 and 62 are small enough so that the total force due to the atmospheric pressure differential is only approximately five pounds. This produces a bowing of the plate 108 which is less than one-twentieth of the wavelength, such an amount of bowing being sufficiently small so as to present essentially no impediment to propagation of the radiation.

In each of the plates 106 and 108, the film is held by its perimetric region by virtue of the clamping of the film by the block 40 and the base 38 or the cap 42. The stretching of the film increases with increased cross-sectional dimensions of the window 10. At lower radiation frequencies wherein waveguides with larger cross-sectional dimensions are employed, it may be necessary to strengthen the plates 106 and 108 by increasing the film thickness. A thin film is preferred for minimizing power loss of radiation transmitted through the film. Thicker films, while having greater strength, also produce greater attenuation of the radiation. Therefore, for higher power and/or lower frequencies, it may be preferable to employ glass or quartz in the construction of the plates 106 and 108, so as to minimize attenuation.

An important feature of he invention is the capacity to replace the spacer block 40 in the field without need for special tools. The quarter wavelength spacing of the plates 106 and 108 varies with wavelength of the radiation. Therefore, in order to operate the window 10 at a lower frequency, it is necessary to employ a thicker spacer block, and at higher frequency, to employ a thinner spacer block. Alternatively, if desired, a spacer block of three quarters wavelength thickness or other odd integral number of quarter wavelengths may be employed. Substitution of one spacer block for another spacer block is readily accomplished by simply removing the screws 72 (FIG. 2) from the cap 42 so as to separate the first waveguide 26 from the window 10. Thereupon, the screws 44 are removed to disassemble the window 10. Then, the spacer block 40 is replaced with a slightly thicker or slightly thinner spacer block to optimize the capability of the window 10 to cancel any reflected waves of radiation. The window 10 is then reassembled and the first waveguide 26 is reattached, whereupon the window 10 is again ready for service. If desired, the foregoing procedure may be employed in the field for replacement of the plates 106 and 108 with plates of other material so as to accommodate, by way of example, an environment of different chemical composition.

It is to be understood that the above described embodiment of the invention are illustrative only, and that modifications thereof may occur to those skilled in the art. Accordingly, this invention is not to be regarded as limited to the embodiment disclosed herein, but is to be limited only as defined by the appended claims.

What is claimed is:

1. A window for transmitting radiation through an aperture in a wall, comprising:

a base secured to a wall, the base extending across an aperture and having a first opening overlying at least a part of the aperture;

a spacer block having opposed front and back surfaces and a second opening extending from said front surface to said back surface, said spacer block being located adjacent to said base;

a front plate and a back plate disposed respectively on said front and said back surfaces of said spacer block, each of said plates extending across said second opening and comprising a radiation-propagating material;

a cap having a third opening, said spacer block being located between said base and said cap, said first and said second and said third openings being coaxial, said front plat abutting said base and said back plate abutting said cap; and means extending from said cap toward said base for removably securing said base and said cap to said spacer lock, a releasing of said securing means permitting replacement of any one of said spacer block and said first plate and said second plate.

2. A window according to claim 1 wherein said aperture provides clearance to a waveguide to permit attachment of the waveguide to said base, said window further comprising attachment means on said base for attachment of said waveguide to said base.

3. A window according to claim 1 further comprising attachment means on said cap for attachment of a waveguide to said cap.

4. A window according to claim 1 wherein said spacer block provides a spacing between said first plate and said second plate of one-quarter of a wavelength of the radiation for attenuation of any reflectance of radiation propagating through the window.

5. A window according to claim 1 wherein said securing means includes a set of pins extending from said cap through said spacer block for alignment of said plates with said block and said cap.

6. A window according to claim 5 wherein said pins extend into said base for alignment of said spacer block with said base.

7. A window for transmitting a radiation through two waveguides, comprising:

a base secured to a first waveguide, the base having an opening extending transversely to a path of propagation of the radiation;

a pane assembly comprising first and second window panes of radiation-progagating material, said pane assembly being disposed on said base with said first pane facing said base;

wherein said pane assembly includes means for spacing said panes apart at a distance of an odd multiple of one-quarter wavelengths of the radiation for attenuation of any reflectance of radiation propagating through the window, each of said panes having a thickness less than one-tenth of wavelength of the radiation; and said pane assembly further comprising cap means secured to a second of said waveguides, the cap means having an opening extending transversely to said path of propagation of the radiation, and wherein said second pane faces said cap means.

* * * * *